United States Patent [19]

Hartley et al.

[11] Patent Number: 4,461,230

[45] Date of Patent: Jul. 24, 1984

[54] BOAT MAST MUFFLER

[76] Inventors: M. Barrie Hartley, 1276 Casitas Pass, Carpinteria, Calif. 93013; David L. Hale, 5674 Stone Canyon Rd., Goleta, Calif. 93117; Vincent Sefcik, 30 Winchester Cyn. Rd., Goleta, Calif. 93117

[21] Appl. No.: 393,185

[22] Filed: Jun. 28, 1982

[51] Int. Cl.[3] ..... B63B 15/00

[52] U.S. Cl. ..... 114/90; 138/93; 174/45 R; 174/70 R

[58] Field of Search ..... 114/90, 91; 138/93; 441/108; 174/45 R, 70 R

[56] References Cited

U.S. PATENT DOCUMENTS 1,288,857 12/1918 Farr ..... 441/108 X 2,279,257 4/1942 Svirsky ..... 138/93

3,889,045 6/1975 Logsdon ..... 114/90 X

*Primary Examiner*—Sherman D. Basinger

*Attorney, Agent, or Firm*—Jack C. Munro

[57] ABSTRACT

An inflatable bladder assembly which is to be located within the hollow interior of a boat mast, which when inflated, is to be pressed against the wall of the interior chamber of the mast. Normally there are elongated wires or cables which are located within the interior chamber of the mast. With the inflatable bladder assembly inflated, these wires and cables will be tightly pressed against the wall of the interior chamber thereby not capable of movement relative thereto and therefore not capable of producing noise. The inflatable bladder assembly is to be composed of a plurality of separate bladder units mounted in a spaced-apart manner on a pressurized air conducting conduit.

2 Claims, 7 Drawing Figures

Fig.1.
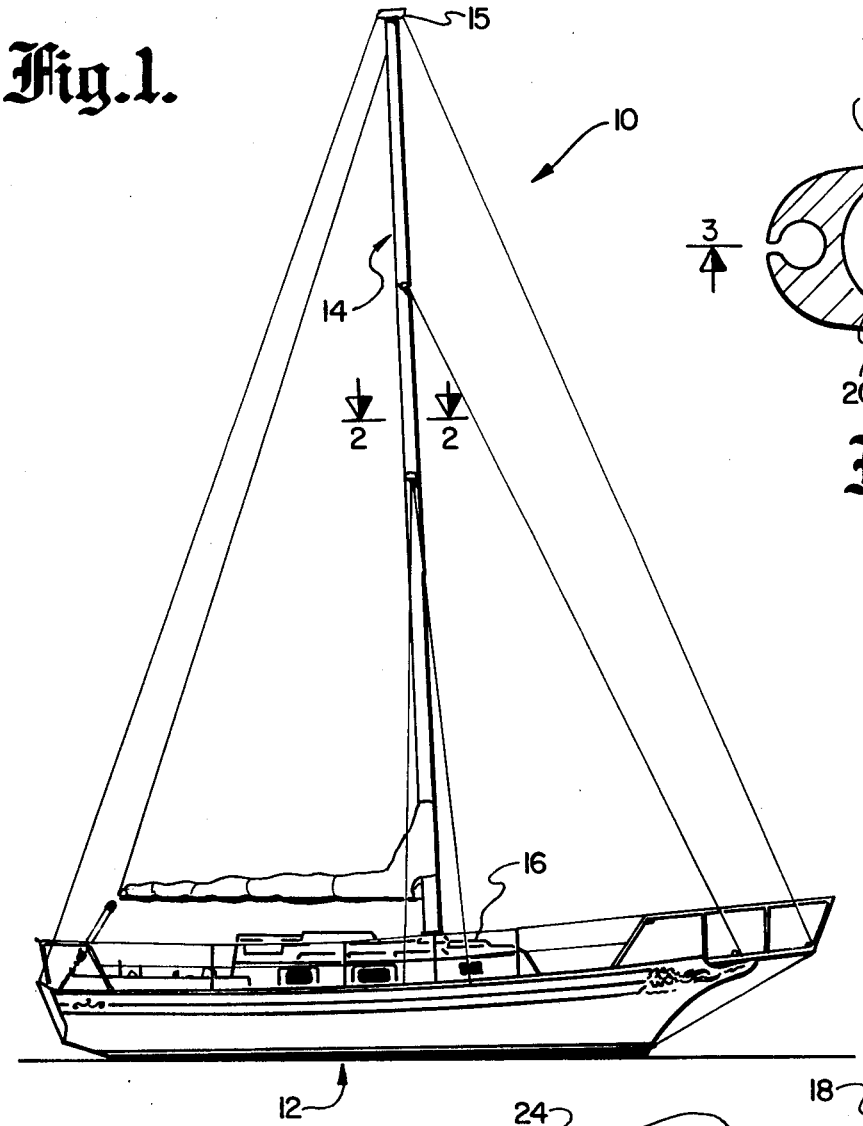
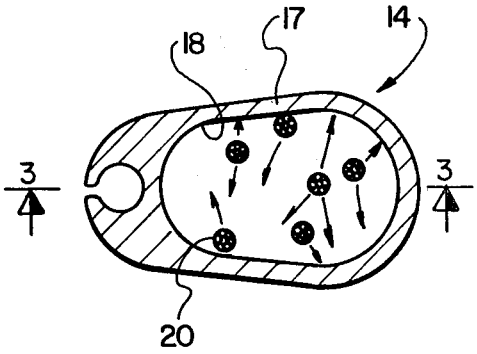
Fig.2.
Fig.3.
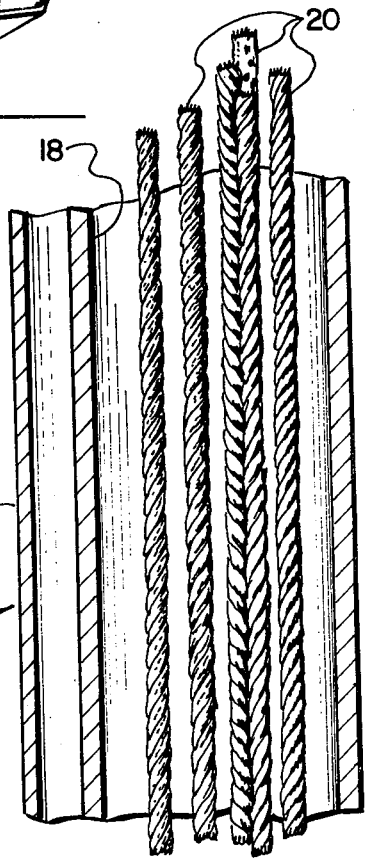
Fig.4.
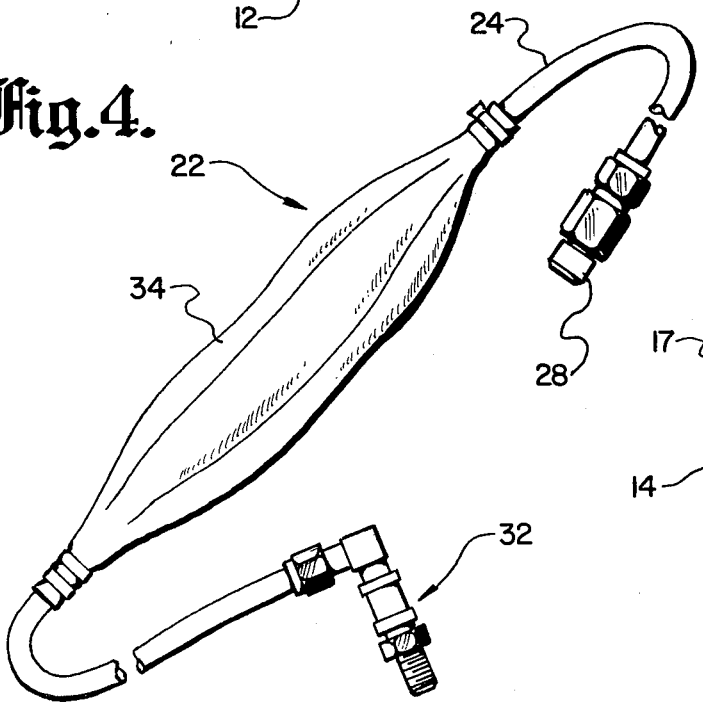

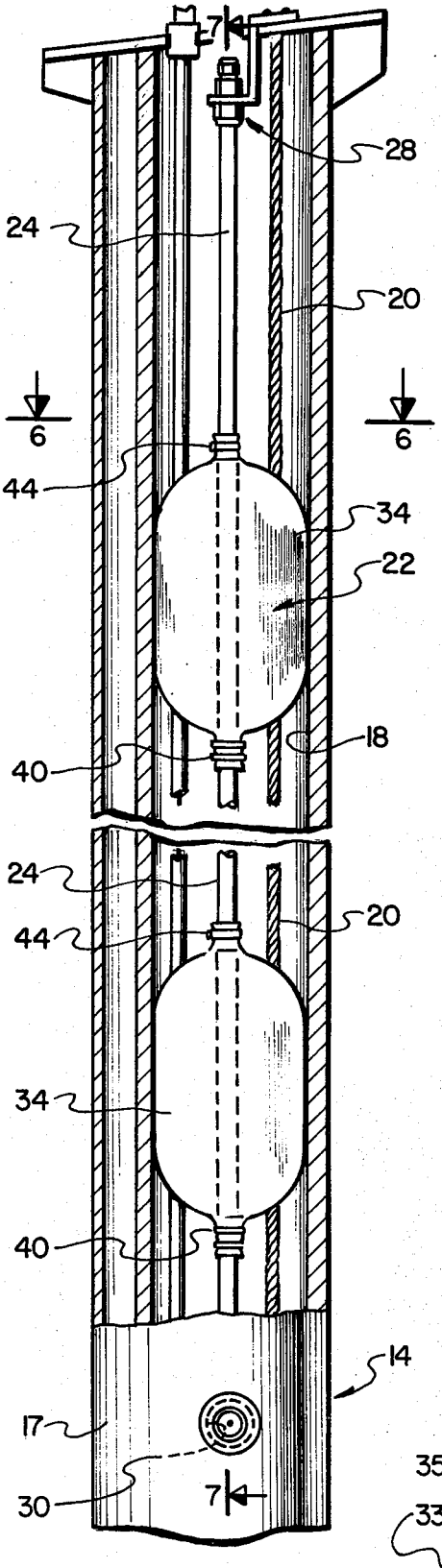
Fig.5.
Fig.6.
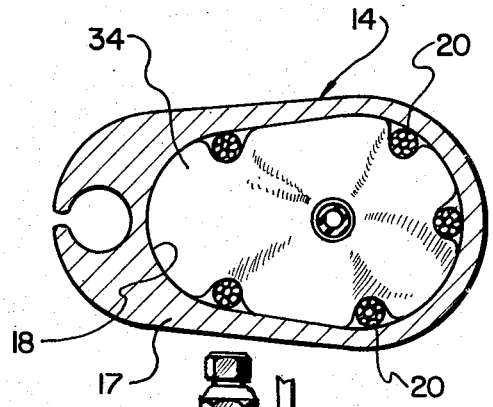
Fig.7.
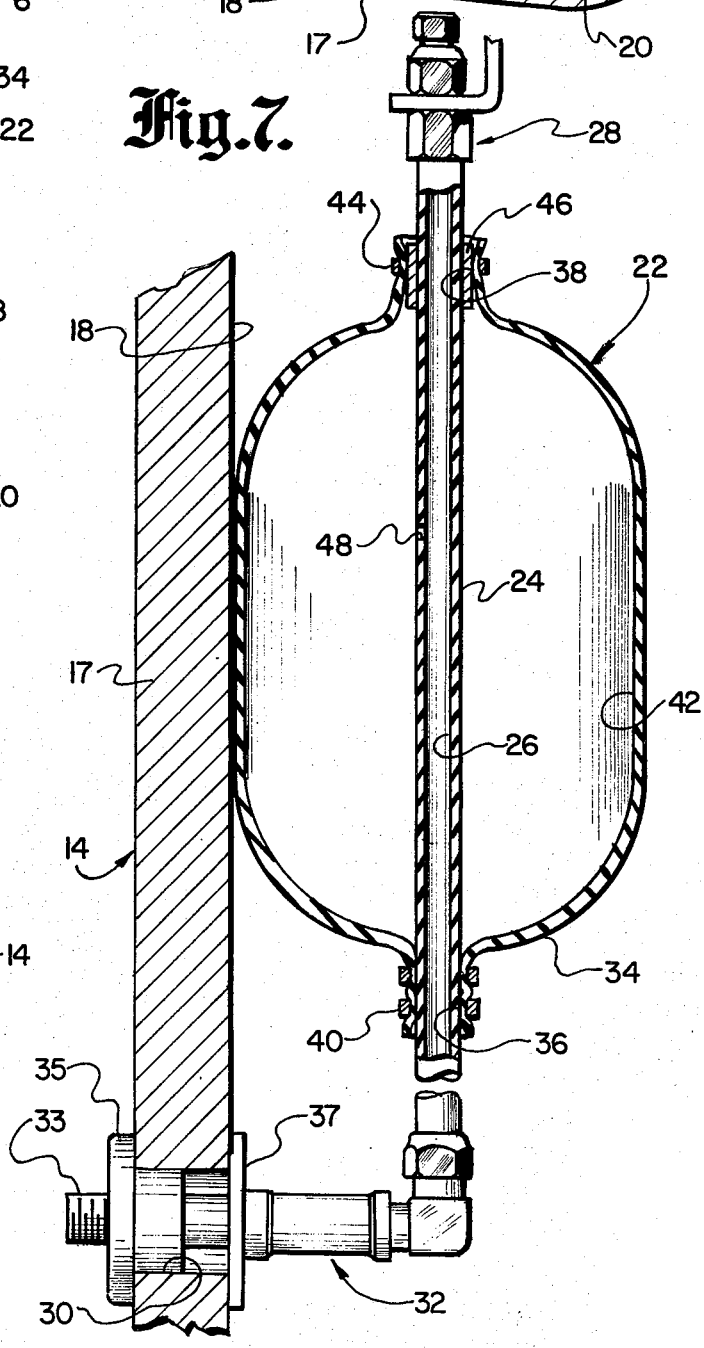

BOAT MAST MUFFLER

BACKGROUND OF THE INVENTION

The field of this invention relates to noise muffling devices, and more particularly to a noise muffler to be used in connection with sailboats.

In the construction of sailboats, it is common that the main mast of the sailboat be from between thirty to one hundred feet in length. In the past, the most common material of construction of the mast was wood. However, in the past few years, a metal mast, which is constructed of aluminium, has been used. Such masts are hollow. This hollow chamber extends from the bottom of the mast to the top of the mast.

It is normally desirable to mount certain devices on top of the mast, such as a wind direction vane, a light, an antenna, etc. This means that there has to be a wire or cable extending from the boat to the device at the top of the mast. Since the mast is hollow, a convenient location for the wire and cable is through the interior of the mast.

During the time a sailboat is at anchor, the sailboat is constantly rolled by wave action. This slight rolling action causes the wires or cables within the mast to slap into the wall of the internal chamber of the mast which creates noise. This noise is continuous and, needless to say, can quickly become extremely irritating to the occupants of the boat. This irritation is most undesirable if the occupants are trying to sleep.

In the past, one way to overcome this slapping action was to fill the mast with some type of material which holds the wires and cables in a fixed position not permitting them to move relative to the mast. A common type of filling material would be a plastic foam. This plastic foam would be added in liquid form which would then harden into a solid unit.

However, periodically it may be required to perform some maintenance on the wire and or cable which is located within the mast. The cable or wire may need to be replaced. Also, there may be a need to install another wire or cable into the mast due to the installing of another device at the top of the mast. Therefore, it is necessary that the filling material of the mast be completely removed prior to completing of any of the previous procedures. This removal of the filling material and the replacing with new material after the performing of the desired task, can become extremely expensive, as well as time consuming.

There is a need to utilize some form of a device which can be located within the interior of the mast which prevents noise from occurring by movement of wires or cables within the mast, which can be installed easily on existing equipment by even the most unskilled individual and also can be readily removed from the mast to gain unhindered access into the interior chamber of the mast.

SUMMARY OF THE INVENTION

The structure of the present invention relates to an inflatable bladder assembly being composed of a plurality of separate bladder units. An inflating conduit of a given length is utilized which is to be substantially equal to the length of the mast from the top of the boat deck to the top of the mast. An inflating valve is mounted within one end of the inflating conduit, with the other end of the inflating conduit being closed. Openings are located through the wall of the inflating conduit at selected locations along the length of the inflating conduit. An inflatable bladder is to be fixedly mounted on the inflating conduit directly over each opening. The closed end of the inflating conduit is then passed through the mast and is then secured at the very top of the mast. The valve at the other end of the inflating conduit is then fixedly secured to the wall of the mast to a portion of the mast directly adjacent the top of the boat. A hole at this part of the mast through the mast wall has been made for the purpose of installing the mast muffler which is then closed by this valve. Pressurized air is then conducted through the valve to thereby inflate each of the bladders sufficiently to press tightly against the wall of the interior chamber of the mast. Normally, each of the bladder assemblies will be located three to six feet apart. When the valve is disengaged from the source of pressurized gas, the valve closes thereby maintaining the inflatable bladders in the inflated state.

The primary objective of this invention is to provide a device which can be installed either within a newly constructed sailboat or on existing sailboats which will eliminate the creation of noise from the slapping of wires or cables within the interior or a sailboat mast.

Another objective of this invention is to provide a device which can quickly and easily be installed within a sailboat mast without requiring any special skill.

Another objective of this invention is to construct a device which is relatively inexpensive.

Another objective of this invention is to construct a device which would muffle noise from the interior of a sailboat mast which can be readily removed for the purpose of providing access into the interior of the mast if such is desired.

BRIEF DESCRIPTION OF THE DRAWINGS

FIG. 1 is a side elevational view depicting a type of sailboat upon which the subject matter of the present invention would be most useful;

FIG. 2 is a cross-sectional view through the mast of the sailboat of FIG. 1 taken along line 2—2 of FIG. 1;

FIG. 3 is a cross-sectional view taken along line 3—3 of FIG. 2;

FIG. 4 is a broken elevational view of the structure of the mast muffler of this invention;

FIG. 5 is a cross-sectional view similar to FIG. 3 but with the mast muffler assembly of the present invention being installed within the interior of the mast;

FIG. 6 is a cross-sectional view through the mast taken along line 6—6 of FIG. 5; and FIG. 7 is a broken cross-sectional view of the mast muffler of the present invention taken along line 7—7 of FIG. 5 but showing only a single inflatable bladder.

DETAILED DESCRIPTION OF THE SHOWN EMBODIMENT

Referring particularly to the drawings, there is shown in FIG. 1 a sailboat 10 which generally is formed of hull 12 and a mast 14. The mast 14 extends from the deck 16 of the boat to the top 15 of the mast 14. The mast 14 is to be constructed of a metal wall 17 which includes an interior chamber 18. Located within the interior chamber 18 are a plurality of elongated members 20. The elongated members 20 will normally comprise wires and cables. It is to be understood that there can be only one or a plurality of elongated members located within the internal chamber 18.

To be located within the interior chamber 18 is the muffler apparatus 22 of this invention. The muffler apparatus 22 comprises an inflating conduit 24 which has an interior passage 26. Conduit 24 is to be flexible and will normally comprise some type of a hose. One end of the conduit 24 is closed by means of a plug assembly 28. This plug assembly 28 is fixedly mounted directly adjacent the top 15 of the mast 14 and is to be secured to the wall 17 of the mast 14.

The installation of the muffler apparatus 22 is achieved by inserting the plug 28 through an opening 30 formed within the wall 17 of the mast 14 directly adjacent the deck 16 of the sailboat 10. A wire, rope or cable (not shown) is to be conducted from the top of the mast 14 to the opening 30 and attached to the plug 28. The plug 28 is as well as the conduit 24 is then pulled completely through the length of the exterior chamber 18 to the top of the mast 14. When in this installed position, there is an inflating valve assembly 32, which is deemed to be conventional, which closes the lower or free end of the conduit 24. This inflating valve assembly 32 includes a threaded sleeve 33. A nut 35 connects with sleeve 33. The nut 35 closes opening 30. A washer 37 abuts the inside wall of the mast 14. The washer 37 prevents outward movement of valve 32. It has been found that the opening 30 only needs to be approximately one inch in diameter.

A latex or other type of bladder 34 is to be fixedly mounted onto the conduit 24. It it to be understood that there will normally be a plurality of bladders 34 mounted on the conduit 24 in a spaced-apart manner. The spacing between adjacent bladders 34 will normally be three to six feet.

Each bladder 34 includes an access opening 36 in the lower end thereof and in the upper end thereof there is included an access opening 38. It is only necessary to air tightly secure the portions of the bladder 34 directly about the access openings 36 and 38 to the conduit 24 so as to prevent leakage of air from the interior 42 of the bladder 34 past the openings 36 and 38. This can be obtained by clamping the portion of the bladder 34 about the access opening 36 onto the conduit 24 by means of a hose clamp assembly 40. A clamping band 44 could also be utilized which is shown clamping the wall of the inflatable bladder 34 about the access opening 38 onto a sleeve 46. The sleeve 46 forms an airtight connection with the conduit 24. The function of the sleeve 46 is to prevent collapsing of the conduit 24. It is to be understood that any desirable airtight conventional connection could be utilized between the bladder 34 about the access openings 36 and 38.

In order to permit the pressurized air within the passage 26 to enter the chamber 42 of each bladder 34, a hole 48 is formed within the wall of the conduit 24 in the area which is to be ultimately covered by the bladder 34. It is to be understood that the hole 48 will be formed prior to the installing of the particular bladder 34 thereover. In actual practice, the position of each hole 48 will be carefully selected so that each bladder 34 when it inflates, will not come into contact with any structure which protrudes within the internal chamber 18 of the mast 14. For example, the mast does include joints at spaced-apart intervals. These joints normally include flanges as well as fasteners that protrude or extend a half an inch or an inch within the internal chamber 18. Therefore, the position of each hole 48 is carefully selected so that each bladder 34 will not abutt any undesirable structure.

What is claimed is:

1. In combination with a boat, said boat having a deck, said boat having a mast, said mast having a lower end located directly adjacent to said deck and an upper end spaced furthest from said deck, said mast being hollow forming an internal chamber extending entirely through said mast, elongated members (such as a wire or cable) being located within and conducted entirely through said internal chamber, muffler means located within said internal chamber for fixing the position of said elongated members to thereby eliminate noise produced by said elongated members contacting the wall of said internal chamber due to movement of said boat, said muffler means comprising:

an inflatable bladder assembly mounted within said internal chamber, said inflatable bladder assembly to be inflatable to press against the wall of said internal chamber binding said elongated members therebetween thereby eliminating the producing of noise by movement of said elongated members against the wall of said internal chamber, said inflatable bladder assembly including a plurality of separate bladder units being located in a spaced-apart manner throughout said internal chamber, said inflatable bladder assembly including an inflating conduit, said separate bladder units being mounted on said inflating conduit, said inflating conduit having a plurality of spaced-apart openings formed through the wall of said inflating conduit, a said separate inflatable bladder unit being attached to said inflating conduit directly over each said opening, each said separate bladder unit includes a pair of access openings, said inflating conduit passes through said access openings with such being tightly closed about said inflating conduit, whereby pressurized gas is to be conducted through said inflating conduit and through said openings to thereby expand each said bladder unit.

2. The combination as defined in claim 1 including:

an inflation valve attached to one end of said inflating conduit, said inflation valve being mounted to said mast at said lower end, said inflation valve being adapted to be connected to a source of pressurized gas, the at-rest position of said inflation valve being normally closed; and the other end of said inflating conduit being secured to a mounting bracket, said mounting bracket being secured to said upper end of said mast.

* * * * *